US006068472A

United States Patent [19]

Freeman et al.

[11] Patent Number: 6,068,472

[45] Date of Patent: May 30, 2000

[54] METHOD OF MAKING CANDLE

[76] Inventors: Scott H. Freeman, 3632 Rebel Cir., Huntington Beach, Calif. 92649; Frank H. Asbury, 144 N. Trevor St., Anaheim, Calif. 92806

[21] Appl. No.: 09/420,879

[22] Filed: Oct. 19, 1999

Related U.S. Application Data

[63] Continuation-in-part of application No. 09/337,292, Jun. 21, 1999.

[51] Int. Cl.[7] ..... F23D 3/16

[52] U.S. Cl. ..... 431/291; 431/288

[58] Field of Search ..... 431/288, 291

[56] References Cited

U.S. PATENT DOCUMENTS

| | | | |
|---|---|---|---|
| 3,583,853 | 6/1971 | Schram | 431/291 |
| 4,568,270 | 2/1986 | Marcus | 431/288 |
| 5,927,965 | 7/1999 | Pappas | 431/288 |

*Primary Examiner*—Carroll Dority

*Attorney, Agent, or Firm*—Stetina Brunda Garred & Brucker

[57] ABSTRACT

A decorative candle. The candle comprises a container that defines an interior chamber. Disposed within the interior chamber is a candle core having a top surface, a bottom surface, an outer surface, and a bore. The candle core is disposed within the interior chamber such that the bottom surface of the candle core is in abutting contact with the container and a cavity is formed between the outer surface and the container. The candle further comprises a wick disposed within the bore of the candle core. Disposed within the cavity and bore is an outer layer of a wax mixture. The outer layer has a melting point less than the melting point of the candle core such that the outer layer can be poured over the candle core without melting the same. The candle further includes at least one component placed upon a top surface of the top layer. Additionally, a top layer of the wax mixture is disposed on the top surface of the outer layer. The top layer partially encapsulates the component and the wick. Preferably, the top layer has a melting point lower than the melting point of the component such that the component will not melt when the top layer is poured into the container.

24 Claims, 2 Drawing Sheets

METHOD OF MAKING CANDLE

CROSS-REFERENCE TO RELATED APPLICATIONS

The present application is a continuation-in-part of U.S. Application Ser. No. 09/337,292 entitled PARAFFIN/PETROLEUM CANDLE AND METHOD OF FORMING THE SAME filed Jun. 21, 1999, the disclosure of which is expressly incorporated herein by reference.

STATEMENT RE: FEDERALLY SPONSORED RESEARCH/DEVELOPMENT (Not Applicable)

BACKGROUND OF THE INVENTION

The present invention generally relates to decorative candles and more particularly to an efficient method of making the same.

Candles have become popular for decorative purposes and as such are being formed in different styles, shapes and colors. Typically, there are three different types of candles: tapered, molded and container. The candles may be manufactured from wax such as paraffin wax, vegetable wax, or beeswax.

A molded candle is formed by pouring molten wax into a mold containing a candle wick. The wax is allowed to cool such that it solidifies and the candle is removable from the mold thereby forming the candle. Tapered candles are formed by dipping a wick into molten wax. Each time the candle is dipped into the molten wax, the wax, adheres to itself thereby forming the tapered candle.

Referring to FIG. 1, a prior art container candle 10 is formed by pouring molten wax 12 into a container 14. After being poured into the container 14, the molten wax 12 is allowed to cool. However, the molten wax 12 shrinks and contracts while cooling. As such, the wax 12 will shrink in the container 14 and thereby cause a space or gap to form between the wax 12 and the inner sides of the container 14.

Disposed within the container 14 is a wick 16 extensible through the wax 12 and protruding through a top surface thereof. Referring to FIGS. 2–4, the wick 16 of the prior art container candle 10 is attached to a wick holder 18 to support the wick 16 within the container 14 during pouring of the molten wax 12 thereinto. In order to burn the wick 16 of the container candle 10, the wick 16 must have a generally vertical orientation such that the wick 16 protrudes from the top surface of the wax 12, as seen in FIG. 1.

In order to maintain the wick 16 in a vertical orientation, the wick 16 may be coated with wax. The wax adds rigidity to the wick 16 such that the wick 16 is maintained upright during the pouring of the molten wax 12. However, a problem arises when pouring the molten wax 12 around the wick 16 because the heat from the molten wax 12 melts the wax maintaining the wick 16 in a vertical orientation. Therefore, the wick 16 is susceptible to bending downwardly thereby rendering the candle 10 useless, as seen in FIG. 2.

In accordance with another prior art method of maintaining the wick 16 in a vertical orientation, often times a support rod 20 will encase the wick 16, as seen in FIG. 3. The support rod 20 maintains the wick 16 in a substantially vertical orientation during pouring of the molten wax 12. However, the support rod 20 typically doesn't burn at the same rate as the wick 16 and is not very pleasing to view. Therefore, the support rod 20 is not an ideal solution for supporting the wick 16 in an upright position.

Another prior art method of maintaining the wick 16 upright is to support the wick 16 in the proper position while the molten wax 12 cools and hardens. Referring to FIG. 4, the wick 16 is moved from a bent position to an upright position as indicated by the arrow. The wick 16 must be held in the vertical position while the wax 12 is cooling in order to form a proper candle 10. However, this method is not advantageous because it adds extra labor to the manufacturing of the candle 10. Specifically, as the wax 12 is being poured, the wick 16 must be supported by either a jig or the hand of a worker pouring the molten wax 12 thereby adding an extra step to the manufacturing process.

Typically, the prior art container candle 10 is formed with a fragrance and/or pigment added to the molten wax 12 before pouring into the container 14. The fragrance can be an oil that is added and mixed with the molten. wax 12. During burning of the wax 12, the fragrance in the oil is released by the melting of the wax 12 immediately surrounding the wick 16. In this regard, only the wax 12 that is burned by the wick 16 releases the fragrance, such that the fragrance in the remainder of the wax 12 is never burned and released. Additionally, the fragrance is unstable such that it may burn unevenly as the candle 10 burns. Accordingly, it is advantageous to use the minimum amount of fragrance in the candle 10. Further, the fragrance is a substantial portion of the cost to manufacture the candle 10. Therefore, it would be advantageous to use the minimum amount of fragrance as possible.

In addition to making candles out of wax, mineral oil has been used to make candles (i.e., gel candles). The mineral oil is gelatinous and solid at ambient temperature. Typically, a gel candle is formed by pouring molten mineral oil gel into a container having a wick. The mineral oil is allowed to cool to its gelatinous state thereby forming a candle within the container. Gel candles burn longer than candles made from paraffin wax because of the high oil content of the gel. Furthermore, gel candles may be scented and/or colored to add more variety to the candles. In addition to making candles from mineral oil gel, decorative elements such as gel components may be fabricated from the mineral oil gel. The gel components are individual pieces of mineral oil gel fabricated into prescribed shapes. The individual gel components may then be placed within the wax candle to provide a decorative appearance.

The present invention addresses the above-mentioned deficiencies in candle manufacturing by providing a method of manufacturing a container candle whereby the wick is fully supported during the manufacturing process. Additionally, the present invention provides a method of manufacturing a container candle whereby the usage of fragrance is minimized, yet burning thereof is maximized. Further, the present invention provides a candle that fully supports and retains gel components in order to add decorative elements to the candle. A container candle manufactured in accordance with the present invention also does not experience shrinkage during the manufacturing thereof.

BRIEF SUMMARY OF THE INVENTION

In accordance with the preferred embodiment of the present invention, there is provided a decorative candle comprising a container which defines an interior chamber. Disposed within the interior chamber of the container is a candle core having a top surface, a bottom surface, an outer surface and a bore extending axially therethrough. Preferably, the candle core is formed from paraffin wax. The bottom surface of the candle core is in abutting contact with the interior of the container when inserted therein. Additionally, the candle core is sized relative to the container such that a cavity is defined between the outer surface of the candle core and the container when the candle core is inserted within the interior chamber. The candle constructed in accordance with the preferred embodiment additionally includes a wick disposed within the bore of the candle core. The bore of the candles core is sized slightly larger than the wick in order for the wick to be advanced through the bore.

The candle further comprises an outer layer of a wax mixture disposed within the cavity formed between the candle core and the container. The outer layer of the wax mixture covers the top and outer surfaces of the candle core and defines a top surface. In the preferred embodiment, the outer layer is additionally disposed within the bore of the candle core and partially encapsulates the wick contained therein. Preferably, the outer layer is formed from a paraffin and petrolatum wax mixture that has a melting point less than the melting point of the candle core. The wax mixture may contain a fragrance and/or pigment as desired.

The candle constructed in accordance with the preferred embodiment further comprises at least one component disposed on the top surface of the outer layer. The component may be a gelatinous component formed from a mineral oil gel.

A top layer of the wax mixture is disposed on the top surface of the outer layer. The wax mixture of the top layer may be a mixture of paraffin and petrolatum and has a melting point less than the melting point of the component disposed on the outer layer. The top layer partially encapsulates the component and secures the same to the candle.

In accordance with the preferred embodiment of the present invention, there is provided a method of fabricating the candle of the present invention. The method comprises the first step of providing a container which defines an interior chamber. Next, the candle core is formed from a first wax material having a first melting point. The candle core has an interior bore and is sized relative to the container such that a cavity will be defined between the candle core and the container when the candle core is inserted within the interior chamber. Preferably, the first wax material is a sheet of paraffin wax and the candle core is formed by drilling the same from the sheet.

The wick for the candle is inserted into the interior chamber of the container. The candle core is then placed within the interior chamber of the container such that the wick is advanced through the bore of the candle core. The outer layer of the molten wax material is then poured within the interior chamber of the container. The outer layer is poured within the cavity and the bore of the candle core such that the outer layer defines a too surface thereof.

Once the outer layer has cooled, at least one component is placed upon the top surface of the outer layer. Preferably, multiple components fabricated from a mineral oil gel are placed upon the top surface of the outer layer.

A top layer of the molten wax mixture is then poured into the interior chamber. The top mixture is poured to a level whereat the component is partially encapsulated within the top layer. Specifically, the top layer is poured to a level wherein a top surface of the component and the wick protrude from the top surface of the top layer. The melting point of the top layer is less than the melting point of the component such that the component will not melt when the molten wax mixture is poured within the interior chamber of the container.

BRIEF DESCRIPTION OF THE DRAWINGS

These as well as other features of the present invention will become more apparent upon reference to the drawings wherein.

DETAILED DESCRIPTION OF THE INVENTION

Figure 1:
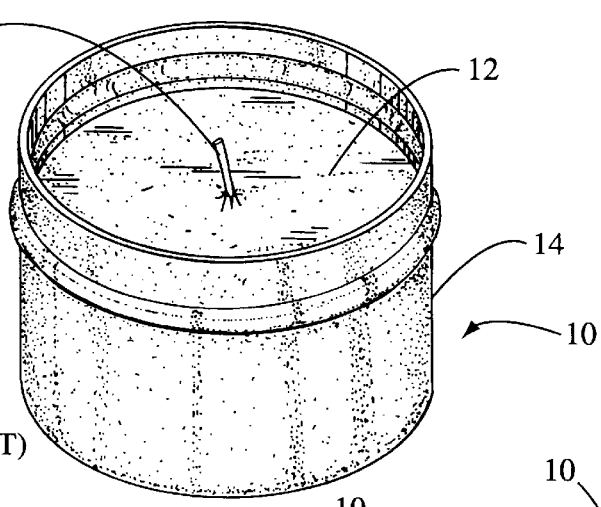
Fig. 1 (PRIOR ART)
FIG. 1 perspectively illustrates a prior art container candle.
Figure 2:
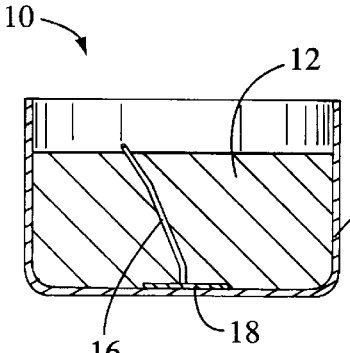
Fig. 2 (PRIOR ART)
FIG. 2 is a cross-sectional view of a prior art container candle with the wick in an improper position.
Figure 3:
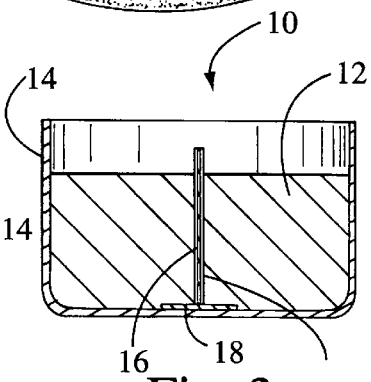
Fig. 3 (PRIOR ART)
FIG. 3 is a cross-sectional view of a prior art container candle with a support rod maintaining the wick in a proper position.
Figure 4:
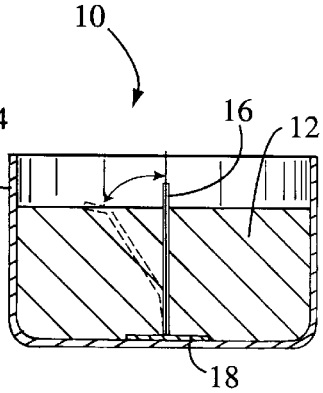
Fig. 4 (PRIOR ART)
FIG. 4 is a cross-sectional view of a prior art container candle wherein the wick is moved to the proper position after the pouring of molten wax into the container.

Referring now to the drawings wherein the showings are for purposes of illustrating a preferred embodiment of the present invention only, and not for purposes of limiting the same, FIG. 1 perspectively illustrates the prior art container candle 10. As previously mentioned above, the prior art candle 10 suffers from the deficiency of not maintaining the wick 16 in a substantially vertical position. As seen in FIGS. 2–4 and as previously mentioned above, there are numerous methods designed to maintain the candle wick 16 in an upright position for the prior art container candle 10.

Figure 5:
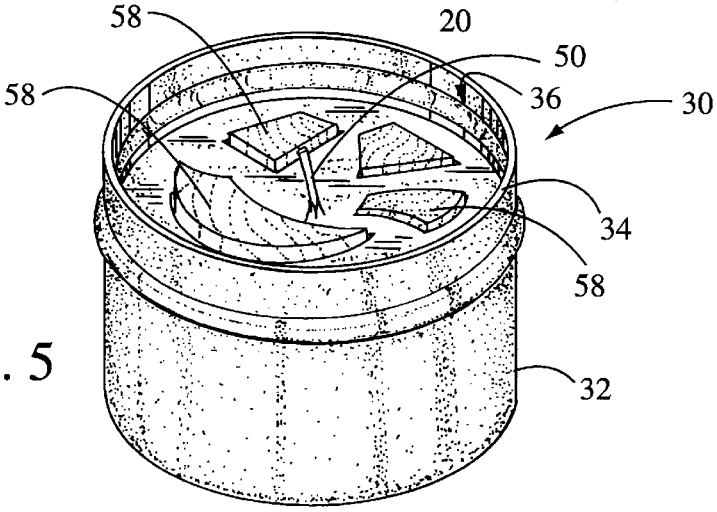
FIG. 5 is a perspective view of a container candle manufactured in accordance with the preferred embodiment of the present invention.

Referring to FIG. 5, a container candle 30 constructed in accordance with the preferred embodiment of the present invention consists of a generally cylindrical container 32 having a rim 34 defining an open top end 36 that allows access into an interior thereof. Typically, the container 32 is formed from a metallic material such as aluminum. However, it will be recognized that other types of materials (i.e., glass, ceramic, etc. . . ) can be used to construct the container 32. The candle 30 may additionally include a lid (not shown) which is placeable over the open end 36 of container 32. The lid is sized to be supported by the rim 34 such that the lid can seal the open end 36 and extinguish any flame of the candle 30.

Referring to FIGS. 7–10, a candle core 38 is disposed within the interior of the container 32. The candle core 38 is formed from conventional paraffin wax used to make candles and typically has a melting temperature between about 125° F. and about 145° F. The paraffin wax used to the make the candle core 38 can be translucent and/or colored with a FD&C ornamental pigment or dye. Typically, the paraffin wax used in the candle core 38 does not contain a fragrance, as will be further explained below.

Figure 7:
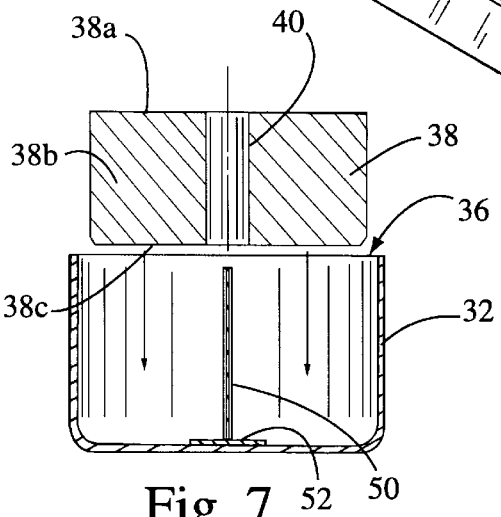
FIG. 7 is a cross-sectional view illustrating the manner in which the candle core is inserted within a container for the candle of the present invention.

In the preferred embodiment of the present invention, the candle core 38 is generally cylindrical and has a top surface 38*a*, an outer surface 38*b* and a bottom surface 38*c*. The diameter of the candle core 38 is smaller than the inner diameter of the container 32 such that the candle core 38 can be inserted into the interior of the container 32. The bottom surface 38*c* of the candle core 38 is in abutting contact with the bottom of the container 32 when inserted therein. Additionally, a void or cavity 39 is created between the container 32 and the outer surface 38*b* of the candle core 38 because as previously mentioned, the diameter of the candle core 38 is less than the inner diameter of the container 32. The candle core 38 further includes a bore 40 extending axially therethrough such that a hollow passage is created through the center of the candle core 38, as seen in FIG. 7.

Figure 6:
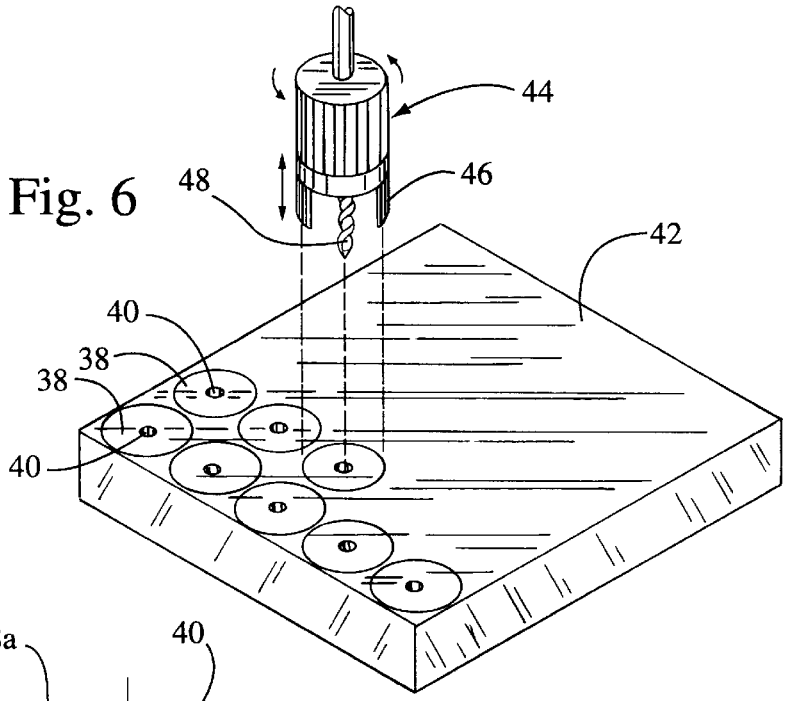
FIG. 6 perspectively illustrates the manner in which candle cores are fabricated for the candle shown in FIG. 5.

Referring to FIG. 6, the candle core 38 is preferably formed from a generally planar sheet 42 of paraffin wax having a thickness that is smaller than the depth of the container 32. The candle core 38 is typically removed from the sheet 42 with a drill bit 44. The drill bit 44 has a generally cylindrical outer bit 46 with a diameter slightly smaller than the diameter of the interior of container 32. Accordingly, the outer bit 46 removes the cylindrically shaped candle core 38 from the sheet 42 of paraffin wax. The bore 40 of the candle core 38 is formed by the passage of the inner bit 48 of the drill bit 44 through the sheet 42. As seen in FIG. 6, as the drill bit 44 rotates, the outer bit 46 cuts and defines the candle core 38 from the sheet 42 while the inner bit 48 simultaneously forms the bore 40. Therefore, the candle core 38 is formed in one quick and simple drilling procedure. It will be recognized to those of ordinary skill in the art that multiple candle cores 38 can be formed from a singular sheet 42 of paraffin wax, as seen in FIG. 6.

The candle 30 additionally includes a wick holder 52 attached to a wick 50. The wick holder 52 maintains the wick 50 in a generally vertical (i.e., upright) orientation. The wick 50 may be fabricated from woven cotton or linen thread and coated with a layer of wax to provide rigidity that maintains the wick in the prescribed upright orientation. As seen in FIG. 7, the wick 50 is positioned on the bottom of the container 32 and the candle core 38 is placed thereover such that the wick 50 is disposed within the bore 40. The diameter of the bore 40 is sized larger than the diameter of the wick 50 in order for the wick 50 to be insertable therein. The interior walls of the bore 40 support the wick 50 in a (generally upright orientation even if the layer of wax disposed on the wick 50 melts away. Additionally, the bore 40 is sized slightly larger than the diameter of the wick 50 such that a wax mixture can be poured therein, as will be further explained below.

Figure 8:
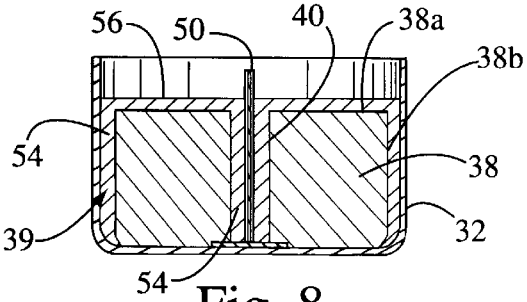
FIG. 8 is a cross-sectional view of the candle of the present invention, illustrating the manner in which a wax mixture is poured around the candle core.

In accordance with the preferred embodiment of the present invention, the candle 30 further includes an outer layer 54 of a wax mixture disposed within the cavity 39 (i.e., between the outer surface 38*b* of the candy core 38 and the container 32). Additionally, the outer layer 54 of the wax mixture is disposed within the bore 40 and covers the top surface 38*a* of the candle core 38, as seen in FIG. 8. Typically, the wax mixture of the outer layer 54 encapsulates the candle core 38 and the wick 50. The outer layer 54 defines a top surface 56 that is disposed above the top surface 38*a* of the candle core 38. Preferably, the wax mixture of the outer layer 54 has a lower melting point than the paraffin wax of the candle core 38 such that the molten wax mixture of the outer layer 54 does not melt the candle core 32 when poured thereover.

The wax mixture is formed from petrolatum and paraffin wax mixed together. Specifically, a prescribed quantity of petrolatum and a prescribed quantity of paraffin wax are both heated to their respective melting points. Once both the petrolatum and the paraffin are completely melted, they are mixed together such that the molten mixture of petrolatum and paraffin can be poured into the container 32 and form the outer layer 54 of the present invention. In the preferred embodiment of the present invention, the wax mixture of the outer layer 54 also includes a fragrance, such as a scented oil, mixed with the petrolatum and paraffin mixture when the wax mixture is in the molten state. The fragrance in the wax mixture is emitted therefrom while the outer layer 54 melts in the candle 30. As previously mentioned, the bore 40 of the candle core 38 is formed slightly larger than the wick 50 such that the wax mixture can be poured therein. As will be recognized to those of ordinary skill in the art, the fragrance in the wax mixture disposed within the bore 40 will be emitted during the burning of the wick 50. The outer layer 54 of the wax mixture may further be colored with a pigment to match the coloring of the candle core 38 or may be translucent.

Figure 9:
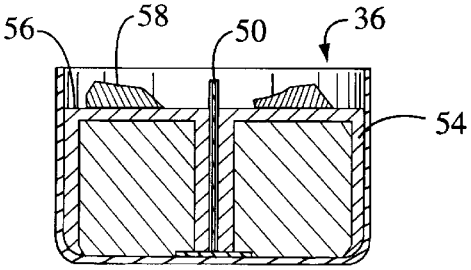
FIG. 9 is a cross-sectional view of the candle of the present invention, illustrating the manner in which gel components are placed upon a top surface of the wax mixture.

The candle 30 further includes a plurality of gelatinous components 58 placed upon the top surface 56 of the outer layer 54 of the wax mixture, as seen in FIG. 9. Each of the gelatinous components 58 is manufactured from a mineral oil gel. The mineral oil gel is solid, yet flexible and capable of retaining its shape unsupported at ambient temperature. Pigments and/or fragrances may be mixed with the gel in order to provide a desired color and/or scent. Examples of such mineral oil gels are "Candle Gel" and "Versa Gel" both of which are manufactured by Penrico of Woodlands, Tex. Each gelatinous component 58 can be configured into decorative designs and shapes that adorn the candle 30, as desired.

The gelatinous components 58 are manufactured by melting a prescribed quantity of mineral oil gel to its melting temperature. Next, the molten mineral oil gel may be poured to form a generally planar sheet. The mineral oil gel is then allowed to cool until the sheet solidifies. Once solid, the sheet is cut with a die to form the gelatinous components 58. Alternatively, the gelatinous components 58 may be formed by extruding a prescribed quantity of molten mineral oil gel through a die. The mineral oil gel is cooled subsequent to the completion of the extrusion process. The extruded and cooled mineral oil gel is cut to a prescribed thickness to form the desired shapes. The melting point of the gelatinous components 58 is higher than the melting point of the wax mixture of the outer layer 54 such that the wax mixture can be poured into the container 32 without melting the gelatinous components 58, as will be further explained below.

Figure 10:
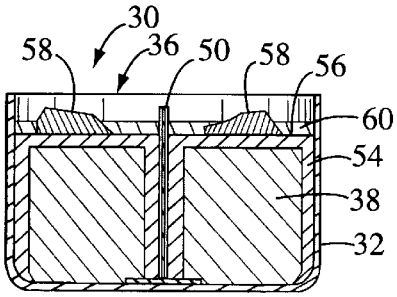
FIG. 10 is a cross-sectional view of the candle shown in FIG. 5.

The candle 30 constructed in accordance with the preferred embodiment of the present invention further includes a top layer 60 of the same wax mixture used for the outer layer 54. The top layer 60 is adjacent to and in abutting contact with the top surface 56 of the outer layer 54. The top layer 60 is formed to a depth that is slightly less than the thickness of the gelatinous components 58 such that each of the gelatinous components 58 protrude from a top surface of the top layer 60, as seen in FIG. 10. Additionally, the top layer 60 is poured such that the wick 50 protrudes from the top surface thereof. As previously mentioned, the melting point of the gelatinous components 58 is higher than the melting point of the wax mixture. Accordingly, the molten wax mixture of the top layer 60 can be poured around the gelatinous components 58 without melting the same. Once the top layer 60 solidifies, each of the gelatinous components 58 is partially encapsulated and secured therein. The wax mixture of the top layer 60 may further include a pigment and/or fragrance that is similar to the pigment and/or fragrance of the outer layer 54. As indicated above in the preferred embodiment of the present invention, the wax mixture of the top layer 60 is the same petrolatum and paraffin mixture used for the outer layer 54. However, it will be recognized by those of ordinary skill in the art, that a different wax mixture may be used for the top layer 60.

The candle 30 constructed in accordance with the preferred embodiment of the present invention minimizes the amount of fragrance used therein but maximizes the amount of fragrance emitted. Specifically, the candle 30 burns the fragrance that is mixed in the bottom and top layers 54 and 60. Because the outer layer 54 of the wax mixture is within the bore 40 of the candle core 38, the wick 50 burns the fragrance contained therein. Accordingly, it is not necessary to have fragrance mixed with the candles core 38 because the fragrance in the wax mixture of the bottom and top layers 54 and 60 is burned and emitted.

Further, in accordance with the present invention, there is provided a method of manufacturing the candle 30. The method comprises the first step of forming the candle core 38 from the sheet of paraffin wax 42, as previously described. Next, the wick holder 52 having the wick 50 attached thereto is inserted into the interior of the container 32. The candle core 38 is inserted over the wick 50 and into the container 32. Specifically, as the candle core 38 is placed within the container 32, the wick 50 is advanced through the bore 40. After the candle core 38 has been placed within the interior of the container 32, the molten wax mixture of paraffin and petrolatum is poured into the interior of the container 32 to form the outer layer 54. The molten wax mixture is poured into the bore 40 of the candle core 38 and into the cavity 39 formed between the outer surface 38*b* of the candle core 38 and the container 32. The wax mixture is poured into the container 32 until the candle core 38 is completely surrounded and enclosed by the outer layer 54 formed thereby, as seen in FIG. 8. After the outer layer 32 has cooled and solidified, the gelatinous components 38 are placed on the top surface 56 thereof. Next, the molten wax mixture of paraffin and petrolatum is poured onto the top surface 56 of the outer layer 54 to form the top layer 60. As previously mentioned, the wax mixture is poured to a level slightly below the top surface of the gelatinous components 58 such that the gelatinous components 58 protrude from the top surface of the top layer 60. Additionally, the wick 50 will protrude from the top surface of the top layer 60 such that the wick 50 can be burned.

The present invention additionally provides a container candle 30 that is safer than the prior art container candles. Because the candle 30 uses solid paraffin wax without fragrance, the candle core 38 can burn consistently. Additionally, the usage of fragrance is minimized thereby reducing the chances that the fragrance will become unstable and burn inconsistently. The candle core 38 additionally provides a container candle 30 that is formed with reduced shrinkage. Because the candle core 38 is formed from solid paraffin wax, only the wax mixture of the top and bottom layers 60 and 54 can shrink when poured within container 32. In the preferred embodiment of the present invention, the top and bottom layers 60 and 54 are formed from a wax mixture of petrolatum and paraffin that minimizes shrinkage upon cooling. Therefore, the wax mixture of the top and bottom layers 60 and 54 will not shrink upon cooling in the candle 30 of the present invention.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A method of manufacturing a decorative candle comprising the steps of:

a) providing a container which defines an interior chamber;

b) forming a candle core having a top surface and an interior bore from a first wax material having a first melting point, the candle core being sized relative to the interior chamber of the container such that a cavity will be defined between the candle core and the container when the candle core is inserted into the interior chamber;

c) inserting a candle wick into the interior chamber of the container;

d) placing the candle core into the interior chamber such that the wick is advanced through the bore of the candle core when the candle core is inserted into the container;

e) pouring an outer layer of a molten wax mixture having a second melting point less than the first melting point into the cavity until the top surface of the candle core is covered thereby;

f) cooling the outer layer of the molten wax mixture, the outer layer defining a top surface when cooled;

g) placing at least one component having a third melting point exceeding the second melting point on the top surface of the outer layer;

h) pouring a top layer of the molten wax mixture onto the outer layer such that the top layer at least partially encapsulates the component; and i) cooling the top layer to secure the component.

2. The method of claim 1 wherein step (b) comprises forming the candle core from a sheet of paraffin wax.

3. The method of claim 2 wherein step (b) comprises:

1) removing the candle core from the sheet of paraffin wax with a drill; and 2) removing the bore from the candle core with a drill.

4. The method of claim 1 wherein steps (e) and (h) comprise pouring a molten wax mixture of paraffin and petrolatum into the container.

5. The method of claim 4 wherein steps (e) and (h) comprise:

1) melting a prescribed quantity of paraffin wax;

2) melting a prescribed quantity of petrolatum; and 3) mixing the molten paraffin wax and the molten petrolatum to form the molten wax mixture of paraffin and petrolatum.

6. The method of claim 5 further comprising the step of mixing a fragrance with the molten wax mixture of paraffin and petrolatum.

7. The method of claim 5 further comprising the step of mixing a pigment with the molten wax mixture of paraffin and petrolatum.

8. The method of claim 1 wherein step (g) comprises placing at least one gelatinous component on the top surface of the outer layer.

9. The method of claim 8 wherein the gelatinous component is formed by:

1) providing a quantity of mineral oil gel;

2) melting the mineral oil gel;

3) forming the molten mineral oil gel into a generally planar sheet;

4) cooling the mineral oil gel until the sheet solidifies; and 5) cutting the sheet with a die to form the gelatinous component.

10. The method of claim 9 further comprising the step of mixing a pigment and a fragrance with the molten mineral oil gel.

11. The method of claim 8 wherein the gelatinous component is formed by:

1) providing a quantity of mineral oil gel;

2) melting the mineral oil gel;

3) extruding and cooling the mineral oil gel through a die to form an extruded member; and 4) cutting the member to form the gelatinous component.

12. The method of claim 11 further comprising the step of mixing a pigment and a fragrance with the melted mineral oil gel.

13. The method of claim 1 wherein step (g) comprises placing multiple components on the top surface of the outer layer.

14. A decorative candle comprising:

a container which defines an interior chamber;

a candle core having a top surface, an outer surface, a bottom surface and a bore, the candle core disposed within the interior chamber such that the bottom surface of the candle core is in abutting contact with the container, the candle core being sized relative to the container such that a cavity is defined between the outer surface of the candle core and the container when the candle core is inserted into the interior chamber;

a wick disposed within the bore of the candle core;

an outer layer of a wax mixture disposed within the cavity and covering the top and outer surfaces of the candle core, the outer layer defining a top surface;

at least one component disposed on the top surface of the outer layer; and a top layer of the wax mixture disposed on the top surface of the outer layer and partially encapsulating the component.

15. The candle of claim 14 wherein:

the candle core has a first melting point;

the wax mixture of the outer and top layers has a second melting point less than the first melting point; and the component has a third melting point that exceeds the second melting point.

16. The candle of claim 14 wherein the melting point of the wax mixture for the top layer is less than the melting point for the component.

17. The candle of claim 14 wherein the at least one component comprises multiple components.

18. The candle of claim 14 wherein the wax mixture contains a fragrance.

19. The candle of claim 14 wherein the wax mixture contains a pigment.

20. The candle of claim 14 wherein the wax mixture is a mixture of petrolatum and paraffin.

21. The candle of claim 20 wherein the mixture of petrolatum and paraffin contains a fragrance.

22. The candle of claim 14 wherein the component is a gelatinous component.

23. The candle of claim 22 wherein the gelatinous component is formed from a mineral oil gel.

24. The candle of claim 14 wherein the outer layer of the wax mixture is disposed within the bore of the candle core and partially encapsulates the wick.

* * * * *